US010473291B2

(12) United States Patent
Cao et al.

(10) Patent No.: US 10,473,291 B2
(45) Date of Patent: Nov. 12, 2019

(54) FILAMENT BULB WITH UNIFORM LUMINANCE

(71) Applicant: XIAMEN ECO LIGHTING CO. LTD., Xiamen (CN)

(72) Inventors: Liangliang Cao, Xiamen (CN); Xiaojuan Huang, Xiamen (CN); Maojin Zeng, Xiamen (CN); Lianwei Zhang, Xiamen (CN); Wanzhen Li, Xiamen (CN); Lilei Su, Xiamen (CN); Mingyan Fu, Xiamen (CN); Xiaobo Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/599,448

(22) Filed: May 18, 2017

(65) Prior Publication Data

US 2018/0306407 A1 Oct. 25, 2018

(30) Foreign Application Priority Data

Apr. 24, 2017 (CN) ..... 2017 1 0268789

(51) Int. Cl.

| | |
|---|---|
| ***F21V 7/04*** | (2006.01) |
| ***F21V 14/04*** | (2006.01) |
| ***F21K 9/232*** | (2016.01) |
| *F21V 23/00* | (2015.01) |
| *H01K 1/46* | (2006.01) |
| *F21V 7/22* | (2018.01) |

(52) U.S. Cl.

CPC ..... *F21V 7/041* (2013.01); *F21K 9/232* (2016.08); *F21V 7/22* (2013.01); *F21V 23/003* (2013.01); *H01K 1/46* (2013.01)

(58) Field of Classification Search

CPC . F21V 7/041; F21V 14/04; F21V 7/22; F21V 23/003; H01K 1/46

See application file for complete search history.

(56) References Cited

U.S. PATENT DOCUMENTS

| | | | | |
|---|---|---|---|---|
| 2010/0246189 | A1* | 9/2010 | Heitmann | F21V 7/10 362/297 |
| 2012/0092850 | A1* | 4/2012 | Pickard | F21V 13/00 362/84 |
| 2014/0374780 | A1* | 12/2014 | Schaefer | H01L 33/507 257/88 |
| 2016/0377237 | A1* | 12/2016 | Zhang | F21K 9/232 362/311.02 |
| 2017/0205031 | A1* | 7/2017 | Xiang | F21K 9/237 |

* cited by examiner

*Primary Examiner* — Tracie Y Green

(74) *Attorney, Agent, or Firm* — Chun-Ming Shih

(57) ABSTRACT

Disclosed herein is a filament bulb with uniform luminance, which decreases the dark area at the top portion of the filament bulb and increases the luminance efficiency, and includes the following components, a bulb casing, a filament unit, a reflector ring, a driver, and a bulb cap. The bulb casing is connected with the bulb cap, and together, the two define an interior space. The driver is disposed in the bulb cap, whereas the filament unit is disposed within the interior space and the bottom of the filament unit is electrically connected with the driver. The reflector ring surrounds the exterior of the bottom of the filament unit, and is configured to reflect the light emitted from the filament unit to decrease the dark area at the top portion of the filament bulb.

7 Claims, 6 Drawing Sheets

FILAMENT BULB WITH UNIFORM LUMINANCE

CROSS-REFERENCE TO RELATED APPLICATION

This application relates to and claims the benefit of Chinese Patent Application No. CN201710268789.2, filed Apr. 24, 2017, the content of which is incorporated herein by reference in its entirety.

BACKGROUND OF THE INVENTION

1. Field of the Invention

The present disclosure relates to a lighting device; more particularly, to a lighting device with uniform luminance.

2. Description of Related Art

With the continuous advancement of technology, lighting apparatuses and related technology have become an indispensible part of the modern life. In current settings of domestic lightning, the filament bulbs are still the mainstream lighting devices. However, since the filament bulb emits light using the filaments disposed within the bulb casing, the luminance at the top portion of the bulb casing is often dimmer, thereby forming a dark area, which results in unsatisfactory consumer experiences. On the other hand, a portion of the light may enter the bulb cap and then be absorbed by the bulb cap the driver, thereby reduces the luminance efficiency.

In view of the foregoing, there exists a need in the art for providing an improved filament bulb; such filament bulb shall have a less significant dark area, and therefore exhibit a more desirable luminance effect and a better luminance efficiency.

SUMMARY

In light of the foregoing technical problems, the present inventor proposes the following embodiments to respectively address some or all of the technical problems. Specifically, various embodiments of the present disclosure may solve the technical problem of the dark area at the top portion and achieve the technical effect of increasing the luminance efficiency; moreover, with the design according to embodiments of the present disclosure, the light that is otherwise absorbed by the bulb cap would be reflected, which further supplements the light towards the dark area at the top portion. In this way, embodiments of the present disclosure not only solve the problem of dark area, but also increase the overall luminance efficiency, thereby providing the consumers with a more satisfactory lighting experiences. The filament bulb according to the present embodiments is compatible with the existing sockets for the filament bulbs, and accordingly, the present filament bulb may be used in various lighting apparatuses that use the filament bulb. Different aspects of the present disclosure are respectively directed to a filament bulb with uniform luminance and a lighting apparatus using such filament bulb.

According to one embodiment of the present disclosure, a filament bulb is provided; such filament bulb achieves the technical effect of ameliorating the dark area at the top portion of the filament bulb and increasing the luminance efficiency. The basic components of the present the filament bulb and the arrangement thereof are first described. The filament bulb according to the present embodiment comprises a bulb casing, a filament unit, a reflector ring, a driver, and a bulb cap. The bulb casing and the bulb cap are connected to define an interior space for accommodating the other components. The driver is disposed in bulb cap, whereas the filament unit is disposed in the interior space and the bottom of the filament unit is electrically connected with the driver; in this way, the driver may deliver the external electricity to the filament unit so that the filament unit may emit light. Moreover, the reflector ring is disposed to surround the exterior of the bottom of the filament unit and configured to reflect the light emitted from the filament unit so as to ameliorate the dark area at the top portion. Additionally, the reflector ring may block the light that would otherwise have entered the bulb cap, thereby further ameliorating the problem of the dark area at the top portion and increasing the luminance efficiency.

According to certain embodiments of the present disclosure, the upper surface of the reflector ring has a microstructure. The design of said microstructure facilitates the reflection or diffusion of light from the filament unit so that the light is directed to various direction; as a consequence, it may further improve the luminance uniformity of the light emitted by the present filament bulb. For example, the above-mentioned microstructure may be a plurality of bumps or pits. Said bumps or pits may be designed to have a suitable shape, such as the a circular, elliptical, triangular, quadrangular, pentagonal, hexagonal, or irregular shape.

Moreover, in some embodiments, the sizes of the plurality of bumps or pits disposed on the reflector ring are the same; alternatively, in some other embodiments, the sizes of these bumps or pits may differ. As an example rather than a limitation, in some embodiments, the sizes of the bumps or pits gradually increase from a portion proximal to the filament unit to a portion distal from the filament unit.

In various embodiments, the reflector ring may have a funnel or conical shape, or have a concave upper surface.

Further, in certain embodiments, the body of the reflector ring may be made of one or more reflective materials. For example, a metal foil (e.g., aluminum foil) or a plastic reflector (e.g., those made of thermoplastic resins with reflective particles) may be used to manufacture the reflector ring.

In some other embodiments, the body of the reflector ring may not be reflective, and in these cases, a reflective layer may be formed on the upper surface of the body. For example, it is feasible to form a reflective thin layer on the upper surface of the body with reflective material(s) such as titanium dioxide, silicon dioxide, barium sulfate or metallic material(s) by painting, printing, bronzing, sputtering, or physical vapor disposition (PVD).

A lighting apparatus is provided according to one embodiment of the present disclosure. The lighting apparatus comprises a body a filament bulb according to one of the above-mentioned embodiments of the present disclosure.

The above-mentioned embodiments may solve one or more technical problems due to their respective technical feature(s).

As could be appreciated, this section presents a simplified summary of the disclosure in order to provide a basic understanding to the reader. This summary is not an extensive overview of the disclosure and it does not identify key/critical elements of the present invention or delineate the scope of the present invention.

BRIEF DESCRIPTION OF THE DRAWINGS

The present description will be better understood from the following detailed description read in light of the accompanying drawings as set forth below.

DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

For convenience, certain terms employed in the specification, examples and appended claims are collected here. Unless otherwise defined herein, scientific and technical terminologies employed in the present disclosure shall have the meanings that are commonly understood and used by one of ordinary skill in the art.

As used herein and in the claims, the terms "at least one" and "one or more" have the same meaning and include one, two, three, or more. Furthermore, the phrases "at least one of A, B, and C", "at least one of A, B, or C" and "at least one of A, B and/or C," as use throughout this specification and the appended claims, are intended to cover A alone, B alone, C alone, A and B together, B and C together, A and C together, as well as A, B, and C together.

The following embodiments are provided to solve the above-described technical problems of current filament bulbs. Specifically, various embodiments of the present disclosure have a reflector ring disposed in the filament bulb; such reflector ring may direct the light emitted from the filament toward the top portion of the bulb casing, thereby solving the technical problem of the dark area at the top and achieving the technical effect of uniform luminance. Moreover, the reflector ring blocks the light that would have otherwise entered the bulb cap and further reflects said light, which in turn achieves the technical effect of increasing the luminance efficiency. As compared with the conventional filament bulbs without the present reflector ring, in the case where the energy power is fixed, the luminous flux of the filament bulbs according to the present embodiments is greater; whereas in the case where the same luminous flux is desired, the energy required by the present filament bulb is lower; accordingly, the filament bulbs of the present disclosure further achieve the technical effect of energy saving. Moreover, the filament bulbs of the present disclosure is compatible with the existing sockets for the filament bulbs, and therefore, they may be used in various lighting apparatuses for filament bulbs.

Figure 1:
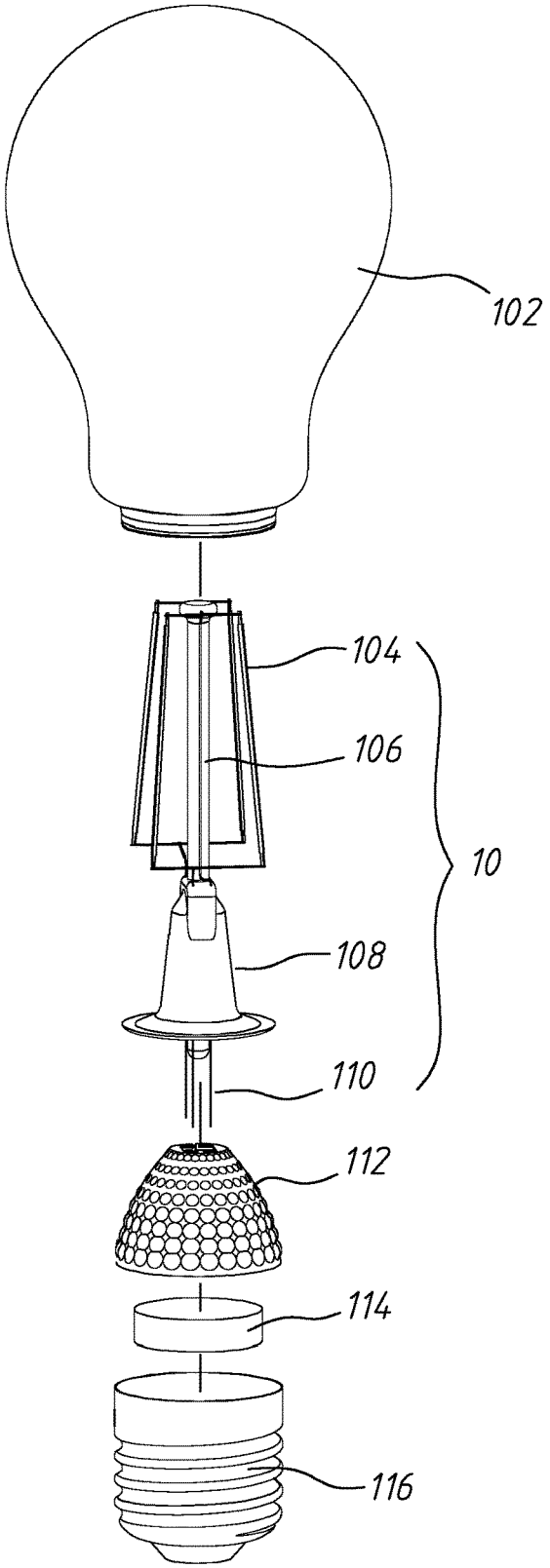
FIG. 1 is an exploded view that schematically illustrates the filament bulb according to one embodiment of the present disclosure.
Figure 2:
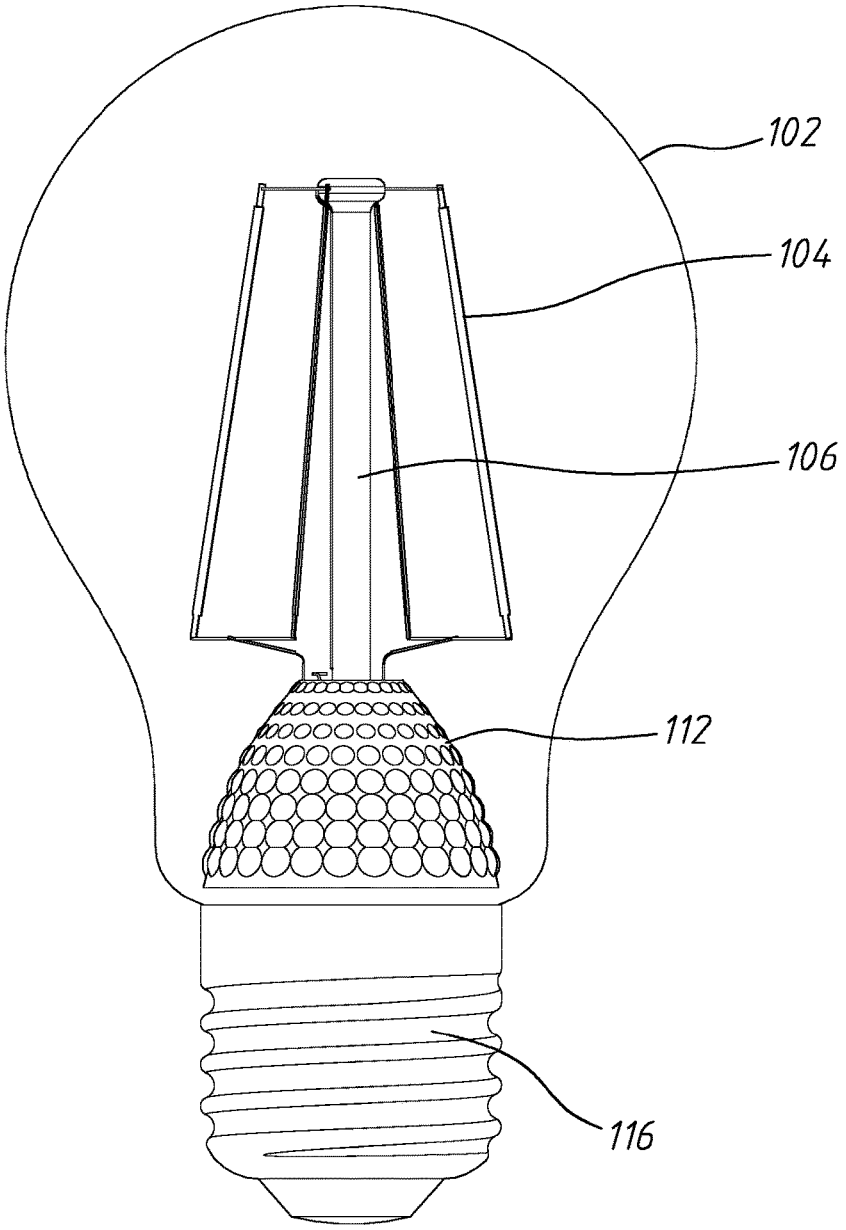
FIG. 2 is a schematic diagram illustrating the filament bulb according to one embodiment of the present disclosure.

Refer to FIG. 1 and FIG. 2, which are respectively an exploded view and schematic view of a filament bulb according to some embodiments of the present disclosure. As illustrated in FIG. 1, said filament bulb 100 with uniform luminance comprises a bulb casing 102, a filament unit 10, a reflector ring 112, a driver 114, and a bulb cap 116. Refer to FIG. 2, the bulb casing 102 and the bulb cap 116 are connected and together, the two components define an interior space for accommodating other components. Upon assembly, the driver 114 is disposed in the bulb cap 116, whereas the filament unit 10 is disposed in said interior space defined by the bulb casing 102 and the bulb cap 116. As illustrated in FIG. 1, the filament unit 10 comprises a plurality of filaments 104, a stem 106, a stem base 108, and two wires 110. In certain embodiments, the filaments 104 are the conventional tungsten filaments. In some other embodiments, the filaments 104 may be light strips comprising light-emitting diodes (LEDs). Specifically, the base of the stem 106 is fixed in the stem base 108; also, one terminal of the filament 104 is connected with one terminal of the stem 106, whereas the other terminal of the filament 104 is electrically connected with the wire 110. The wire 110 passes through the stem base 108. In this way, after the assembly, the wire 110 locates at the bottom portion of the filament unit 10 is electrically connected with the driver 114, so that the driver 114 may be used to deliver the external electric energy to the wire 110 of the the filament unit 10, and then make the filaments 104 of the filament unit 10 emit light.

Figure 3:
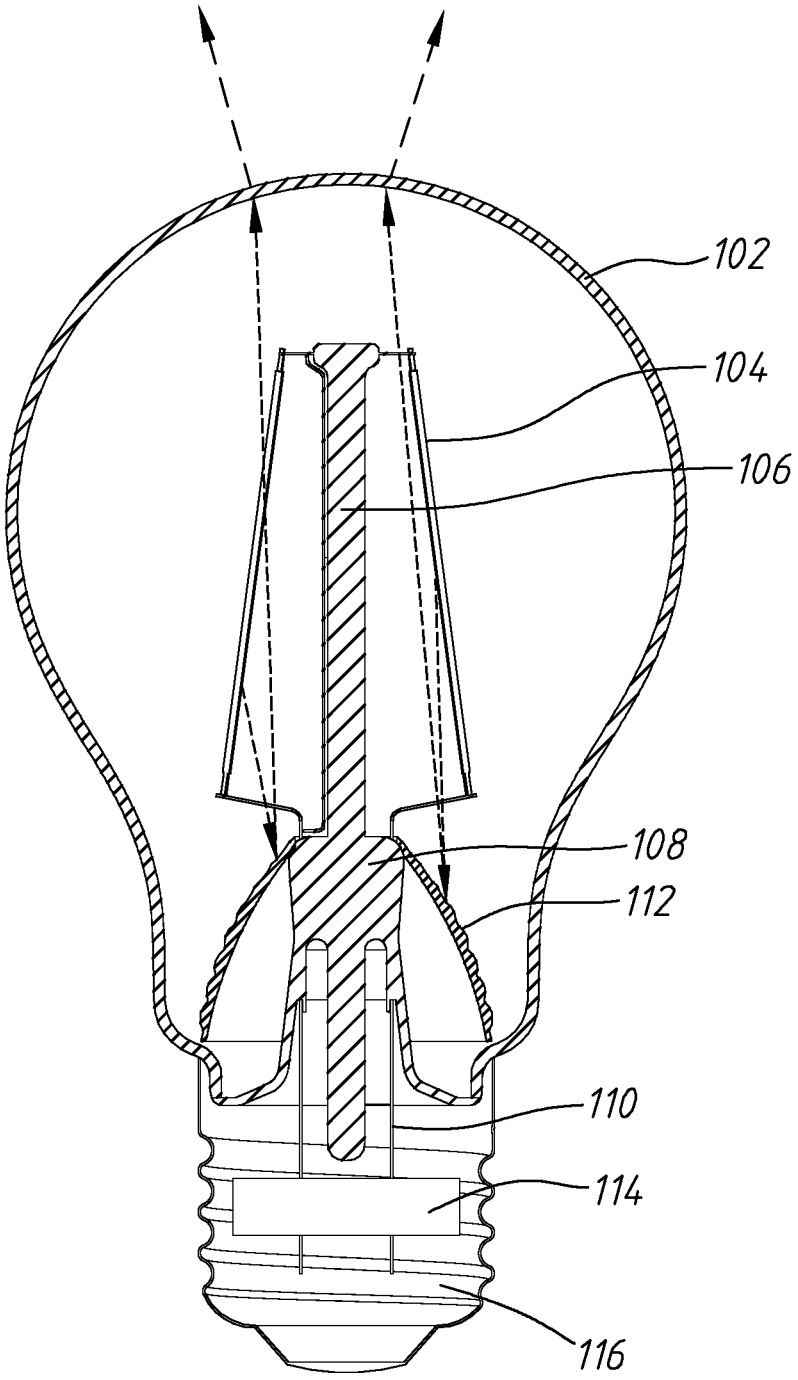
FIG. 3 is a cross-sectional view of the filament bulb according to one embodiment of the present disclosure.

Moreover, the reflector ring 112 that is proposed by the present disclosure for the first time is disposed outside the bottom portion of the filament unit 10; refer to both FIG. 1 and FIG. 2, the reflector ring 112 surrounds the exterior of the stem base 108 of the filament unit 10, and the lower end of the reflector ring is connected with the bulb casing 102. With the configuration of said reflector ring 112, it is feasible to effectively reflect the light emitted from the filaments 104, a direct the light toward the top portion of the bulb casing 102, so that the dark area at the top portion is illuminated, thereby achieving the effect of uniform luminance. Refer to FIG. 3, which is a cross-section view of the filament bulb 100, and it also illustrates the interaction of light emitted from the filaments 104 and reflector ring 112. As illustrated in FIG. 3, some of the light emitted from the filaments 104 (as illustrated in FIG. 3 with lines having downward arrowheads) reach the upper surface of the reflector ring 112; in this case, due to the reflective property at the upper surface of the reflector ring 112, said light would be reflective toward the dark area at the top portion of the bulb casing 102 (as illustrated in FIG. 3 with lines having upward arrowheads), so as to increase the luminance passing through the top portion of the bulb casing 102, thereby ameliorating the issue of the dark area at the top portion. On the other hand, refer to FIG. 2, the reflector ring 112 is configured to separate the interior space of the bulb casing 102 from the interior space of the bulb cap 116, so that the light emitted from the filaments 104 would not enter the interior of the bulb cap 116; additionally, the reflector ring 112 may further reflect such light, which in turn improve the luminance efficiency of the present filament bulb 100.

Figure 4:
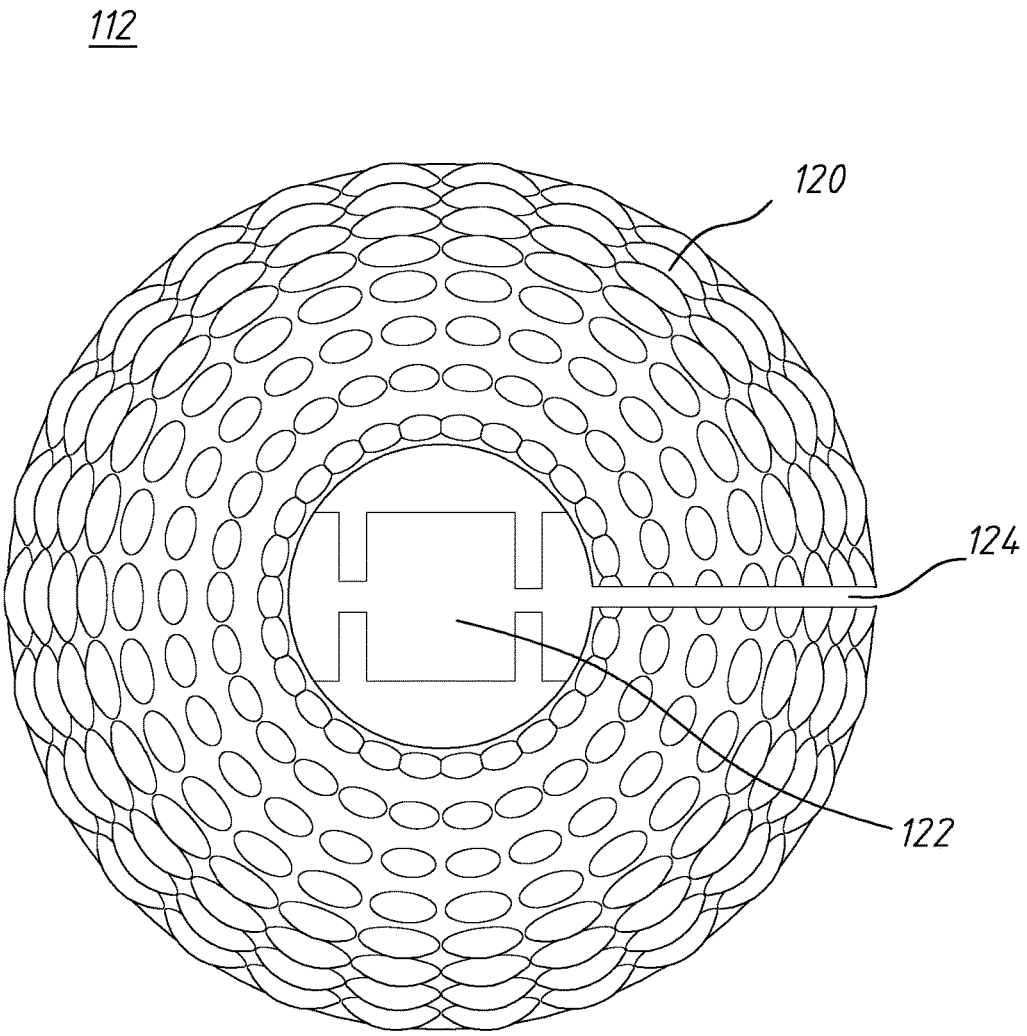
FIG. 4 is a schematic diagram illustrating the reflector ring according to one embodiment of the present disclosure.

FIG. 4 is a top view of the reflector ring 112. As could be seen in FIG. 4, the upper surface of the reflector ring 112 has a microstructure 120. The design of such microstructure 120 facilitates the reflection and/or diffusion of the light emitted from the filament unit; in this way, the luminance uniformity of the present filament bulb is further improved. However, it should be noted that it is not necessary for the reflector ring of the present disclosure to have such microstructure, and in certain embodiments, the reflector ring may have a flat surface without the microstructure of bumps or pits, as long as said reflector ring may reflect the light emitted from the filament unit properly.

In the case where the reflector ring has said microstructure, the microstructure may be a plurality of bumps or pits, or the combination of the two. Said bumps or pits may have any suitable shapes, such as, circular, elliptical, triangular, quadrangular (e.g., square, rectangle, trapezium, parallelogram, rhombus), pentagonal, hexagonal, or irregular shape, or any combination of the above-mentioned shapes. The surface of the bumps or pits is not limited to a flat or round surface; rather, it could be a conical protrusion or recess; for example, in some embodiments, the microstructure may comprises a plurality of pyramid bumps or pits.

The microstructure of the reflector ring 112 illustrated in FIG. 1 to FIG. 4 comprises a plurality of circular bumps, in which the sizes of these circular bumps gradually increase from a portion proximal to the filament unit 10 to a portion distal from the filament unit 10. However, as could be appreciated by persons having ordinary skill in the art, the configuration of the microstructure in these drawing is merely illustrative, and should not be considered as a limitation to the present disclosure.

Still referring to FIG. 4, a through hole 122 is disposed at the central portion of the reflector ring 112 so that the stem 106 of the filament unit 10 may pass through the through hole 122. Moreover, a slit 124 is disposed along the longitudinal direction of the lateral side of the reflector ring 112; while assembling the filament bulb 100, the flexibility of the reflector ring 112 allows the user to expand the slit 124 so that the stem may pass the slit 124 and reach the through hole 122; in this way, the reflector ring 112 clamps at the exterior of the stem 106.

Moreover, the reflector ring 112 illustrated in FIG. 1 to FIG. 4 has a funnel shape; that is, the top opening is narrower as compared with the wider bottom opening, and the lateral wall is slightly raised outward. Yet, the present disclosure is not limited thereto; in other embodiments, the reflector ring may have a conical shape; i.e., the lateral wall is flat and, unlike the funnel shape reflector ring, is not raised. In some other embodiments, the sidewall of the reflector ring may be slightly recessed.

As could be appreciated, persons having ordinary skill in the art, upon reading the disclosure of the present invention, may design the shape of the reflector ring or the presence or absence of the microstructure and the pattern thereof depending on the actual need. For example, the design parameter of the reflector ring may be adjusted depending on the shape or size of the bulb casing or the shape, size and arrangement of the filament unit, so as to maximize the light that is directed toward the dark area at the top portion, thereby achieving the optimal optical characteristics.

Figure 5:
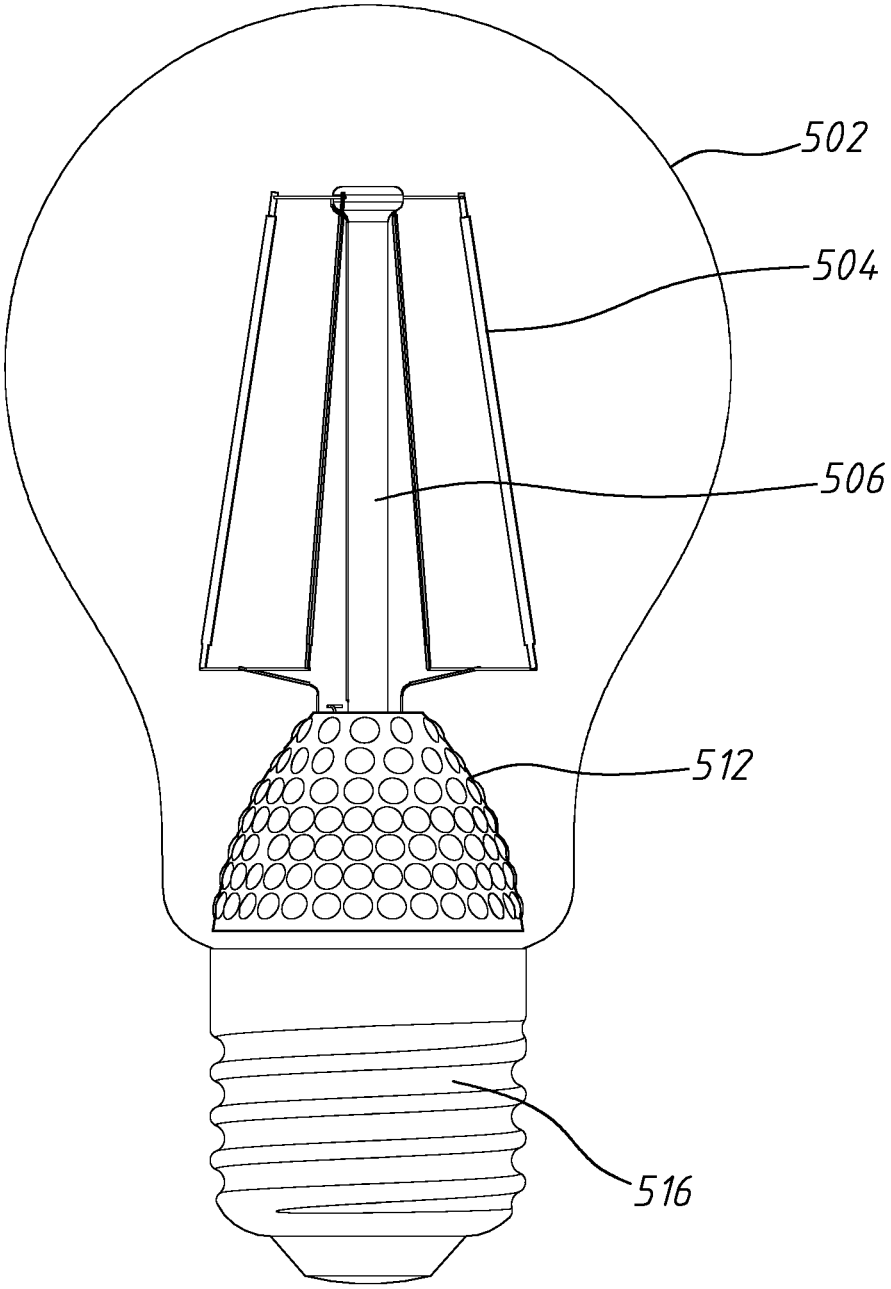
FIG. 5 is a schematic diagram illustrating the filament bulb according to another embodiment of the present disclosure FIG. 6 a schematic diagram illustrating the filament bulb according to yet another embodiment of the present disclosure In accordance with common practice, the various described features/elements are not drawn to scale but instead are drawn to best illustrate specific features/elements relevant to the present invention. Also, like reference numerals and designations in the various drawings are used to indicate like elements/parts.

For example, the filament bulb 500 illustrated in FIG. 5 also comprises a bulb casing 502, filaments 504, a stem 506, a stem base (not show in the drawing), a reflector ring 512, a driver (not show in the drawing), and a bulb cap 516. The components of the filament bulb 500 are substantially the same as those of the filament bulb 100, except that the structure of the reflector ring 512 is different. Specifically, the upper surface of the reflector ring 512 has a microstructure comprising a plurality of circular bumps, in which the sizes of these circular bumps are the same.

Figure 6:
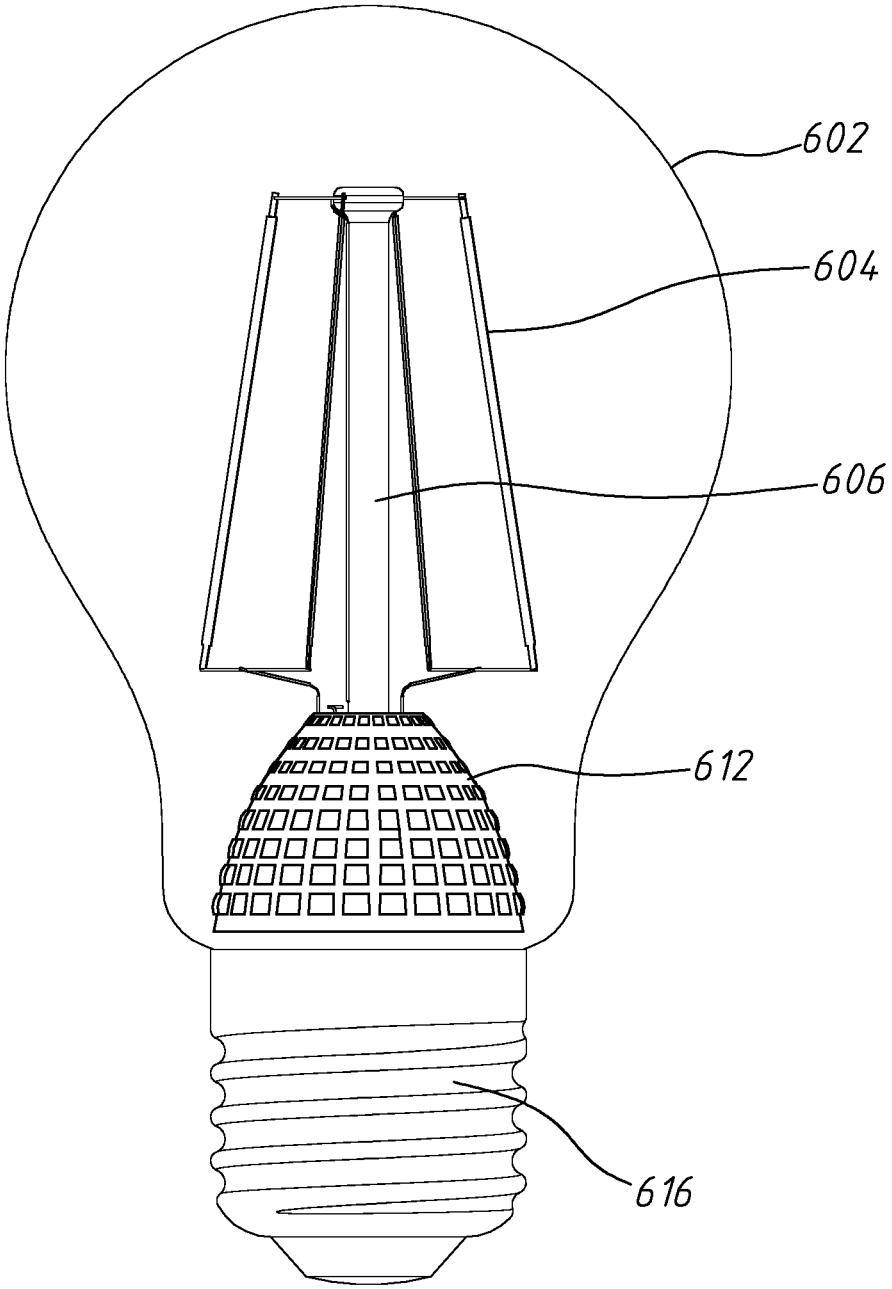

On the other hand, FIG. 6 illustrates a filament bulb 600 according to another embodiment of the present disclosure; the filament bulb 600 comprises a bulb casing 602, filaments 604, a stem 606, a stem base (not show in the drawing), a reflector ring 612, a driver (not show in the drawing), and a bulb cap 616. The components of the filament bulb 600 are substantially the same as those of the filament bulb 100, except that the structure of the reflector ring 612 is different. Specifically, the upper surface of the reflector ring 612 has a microstructure comprising a plurality of rectangular bumps; moreover, the sizes of said rectangular bumps gradually increase from a portion proximal to the filament unit to a portion distal from the filament unit.

The present reflector ring may be used using any suitable material(s). For example, the body of the reflector ring may be made of a reflective material; or the body of the reflector ring may be made using a non-reflective material, and a reflective layer may be formed on the upper surface of the body so that the reflector ring may reflect the light.

In the case where the body of the reflector ring is made of a reflective material, a metal foil or plastic reflective film may be used to manufacture the reflector ring.

Take the metallic foil as an example, the common material includes aluminum foil; however, the present disclosure is not limited thereto, and persons having ordinary skill in the art may select any other suitable metallic material depending on the actual need.

There are two common manufacturing types for making plastic reflective films. According to the first manufacturing type, a thermoplastic material may be mixed with reflective particles so that the thus-prepared plastic film exhibit reflective property. In another manufacturing type, the thermoplastic material is made into a highly-transparent matrix, and a thin, micro-foaming layer is formed on the matrix, in which the micro-foaming layer comprises a plurality of microbubbles having a diameter of several micrometers. In the latter case, the reflectiveness of the thermoplastic film is altered by adjusting the diameter and density of the microbubbles; generally speaking, the smaller the diameter or the denser the microbubbles, the higher the reflectiveness. Common thermoplastic materials include, but are not limited to, polyethylene terephthalate (PET) and polycarbonate (PC). Illustrative examples of reflective particles are, titanium dioxide, silicon dioxide, barium sulfate, calcium carbonate, calcium sulfate, lead oxide, iron oxide, or other metallic materials.

In some other embodiments, the body of the reflector ring may not be reflective, and a reflective layer may be formed on the upper surface of the body. For example, the body of the reflective ring may be made of the thermoplastic material, and reflective layers may be painted, printed, bronzed, sputtered, or deposited by PVD on the upper layer of the body to form a thin reflective layer.

Regarding the raised or recessed microstructure on the reflector ring, said microstructure may be formed using appropriate means depending on the material of the reflector ring. For example, when the reflector ring is made of thin metal foils such as aluminum foil, it is feasible to press the metal foil thereby forming the raised or recessed microstructure on the surface; alternatively, the surface of the metal film may be subjected to grinding, thereby forming the microstructure on the surface.

On the other hand, when the body of the reflector ring is made primarily of thermoplastic material(s), the desired microstructure may be formed during the injection molding process, or an even, flat surface may be formed first, followed by appropriate surface treatment (e.g., grinding) to form the microstructure. Additionally, the above-mentioned micro-foaming technology may be sued to form the microstructure on the surface of the body.

Another aspect of the present disclosure is directed to a lighting apparatus. According to various embodiments, the lighting apparatus comprises a body and a filament bulb. Specifically, the filament bulb may the one according to any of the above-mentioned embodiments of the present disclosure; such filament bulb with uniform luminance may be installed on the body. For example, the body of the lighting apparatus may be fixed on the wall, ceiling, or beam of a building. Alternatively, the body of the lighting apparatus may be moveable; for example, the lighting apparatus may be a table lamp or a floor lamp. Generally, the body may comprises therein a socket for accommodating and electrically connect with the bulb cap of the filament bulb.

The above-mentioned embodiments may solve one or more technical problems due to their respective technical feature(s).

Although various embodiments of the invention have been described above with a certain degree of particularity, or with reference to one or more individual embodiments, those with ordinary skill in the art could make numerous alterations to the disclosed embodiments, such as the addition or deletion of one or more elements, without departing from the spirit or scope of this invention.

What is claimed is:

1. A filament bulb, comprising, a bulb casing, a filament unit, a reflector ring, a driver and a bulb cap, wherein the bulb casing and the bulb cap are connected to define an interior space, the driver is disposed in the bulb cap, the filament unit is disposed in the interior space and the filament unit has a bottom that is electrically connected with the driver, and the reflector ring has an upper surface with a microstructure of bumps, wherein the reflector ring surrounds the exterior of the bottom of the filament unit and is configured to reflect the light emitted from the filament unit.

2. The filament bulb according to the claim 1, wherein the bumps have a circular, elliptical, triangular, quadrangular, pentagonal, hexagonal, or irregular shape.

3. The filament bulb according to the claim 1, wherein the bumps are arranged such that the sizes of bumps gradually increase from a portion proximal to the filament unit to a portion distal from the filament unit.

4. The filament bulb according to the claim 1, wherein the reflector ring comprises a body, and wherein the body is made of one or more reflective materials.

5. The filament bulb according to the claim 4, wherein the reflective material is aluminum foil.

6. The filament bulb according to the claim 4, wherein the reflective material is formed on the upper surface of the body by painting, printing, bronzing, sputtering, or physical vapor deposition.

7. The filament bulb according to the claim 1, wherein the reflector ring has a funnel or conical shape, or the reflector ring has a concave upper surface.

* * * * *